US007082262B2

(12) United States Patent
Clark et al.

(10) Patent No.: US 7,082,262 B2
(45) Date of Patent: Jul. 25, 2006

(54) INTEGRAL MANIFOLD FOR LIQUID MATERIAL DISPENSING SYSTEMS

(75) Inventors: Steven Clark, Cumming, GA (US); Mark A. Gould, Gainesville, GA (US); Kenneth Jones, Marietta, GA (US)

(73) Assignee: Nordson Corporation, Westlake, OH (US)

( * ) Notice: Subject to any disclaimer, the term of this patent is extended or adjusted under 35 U.S.C. 154(b) by 232 days.

(21) Appl. No.: 10/830,613

(22) Filed: Apr. 22, 2004

(65) Prior Publication Data

US 2005/0236430 A1 Oct. 27, 2005

(51) Int. Cl.
*H05B 3/68* (2006.01)

(52) U.S. Cl. ..... 392/465; 222/146.2; 392/485

(58) Field of Classification Search ..... None
See application file for complete search history.

(56) References Cited

U.S. PATENT DOCUMENTS

| | | | | | |
|---|---|---|---|---|---|
| 3,115,282 | A * | 12/1963 | McKenzie | 222/318 |
| 3,612,069 | A * | 10/1971 | Waters et al. | 132/212 |
| 4,549,866 | A * | 10/1985 | Granville | 432/10 |
| 4,653,199 | A * | 3/1987 | McLeod et al. | 34/80 |
| 4,688,609 | A * | 8/1987 | Diaz | 141/82 |
| 4,874,014 | A * | 10/1989 | Grant et al. | 137/606 |
| 6,260,583 | B1 | 7/2001 | Flatt et al. | 137/884 |
| 6,435,425 | B1 | 8/2002 | Saidman | 239/290 |
| 6,572,033 | B1 | 6/2003 | Pullagura et al. | 239/399 |
| 6,601,741 | B1 * | 8/2003 | McGuffey | 222/504 |
| 6,931,205 | B1 * | 8/2005 | Atkins | 392/484 |
| 2003/0200921 | A1 | 10/2003 | Crane et al. | |
| 2004/0033069 | A1 * | 2/2004 | Atkins | 392/484 |

OTHER PUBLICATIONS

Watlow Electric Manufacturing Company, *Revolutionizing the Heater Industry,* Brochure, 7 pgs., 2001.

* cited by examiner

*Primary Examiner*—Thor S. Campbell
(74) *Attorney, Agent, or Firm*—Wood, Herron & Evans, L.L.P.

(57) ABSTRACT

A manifold for a liquid material dispenser has a unitary manifold body with process air and liquid material passages formed therethrough. Heaters for heating the process air and liquid material are both coupled directly to the manifold body and cooperate to simultaneously heat both the air and liquid material. The air and liquid material heaters may be arranged in either a generally vertical orientation, or a horizontal orientation with respect to the manifold body. In one embodiment, the process air heater includes a cylindrical member which is substantially exposed to the process air to optimize heat transfer from the cylindrical member to the process air.

12 Claims, 11 Drawing Sheets

INTEGRAL MANIFOLD FOR LIQUID MATERIAL DISPENSING SYSTEMS

FIELD OF THE INVENTION

The present invention relates generally to liquid material dispensing systems, and more particularly to applicators for dispensing controlled patterns of thermoplastic material to a substrate.

BACKGROUND OF THE INVENTION

Dispensing systems for supplying liquid material and filaments in other forms are conventionally used to apply thermoplastic materials, such as hot melt adhesives, to various substrates during the manufacture of diapers, sanitary napkins, surgical drapes, and other substrates. Typically, liquid material and pressurized air are supplied to the dispenser where they are heated and distributed to one or more dispensing modules for application to the substrate. The heated liquid material is discharged from the dispensing module while pressurized air is directed toward the dispensed liquid to attenuate or draw down the dispensed liquid material and to control the pattern of the liquid material as it is applied to the substrate.

Conventionally, liquid material dispensing systems have utilized separate manifolds for heating and supplying the pressurized air and liquid material to the dispensing modules. Accordingly, the separate air and liquid material manifolds use separate heaters specifically dedicated to heat the respective air and liquid material. Generally, the requirements for heating the liquid and air are different, therefore, different types of heating elements are typically used for each heater and the heating elements are separately controlled. This in turn contributes to increased manufacturing costs and the need to stock multiple service parts. Having separate air and liquid material manifolds also inhibits making the dispensers compact in size. Because the air and liquid material heaters are separately controlled, heat generated from one heater can interfere with the temperature control of the other material. For example, the heater for heating the air may be turned off by a controller in an effort to reduce the temperature of the pressurized air, but heat generated by the liquid material heater may continue to heat the air, thereby effectively contravening efforts to control the air temperature with the air heater. Finally, a dispenser having separate manifolds increases manufacturing time due to the need to couple together the individual manifolds to produce the adhesive dispenser.

Adhesive dispensing systems generally have manifolds configured to accommodate a fixed number of adhesive dispensing modules. Often, however, it is desirable to have an adhesive dispenser of a modular configuration which permits manifolds of the dispenser to be joined together or separated to permit flexibility in increasing or decreasing the number of modules which can be used in a given application. Such modular adhesive dispensers present unique challenges such as maintaining uniform heating across all modules so that liquid material is uniformly dispensed to the substrate, particularly from dispensing modules located at the ends of each manifold where less heat from the manifold heaters is transferred to the liquid material due to heat losses through the ends of the manifold.

A need therefore exists for an improved liquid material dispensing system which addresses various drawbacks of prior dispensing systems, such as those described above.

SUMMARY OF THE INVENTION

The present invention provides an integrated manifold for a dispensing system, as well as a dispenser incorporating the manifold, preferably used to dispense hot melt adhesives in an air assisted manner. The dispenser dispenses liquid material and process air from at least one dispensing module coupled to the manifold. The manifold of this invention integrates a process air distribution portion and a liquid distribution portion into a common, integral manifold body or block, which is preferably an aluminum extrusion. Unlike conventional hot melt adhesive systems, the power requirements for heating the process air are shared between a heater specifically designed to heat the incoming process air and at least one additional heater which heats both the liquid material and the process air.

More specifically, an integrally formed manifold body is configured to receive one or more of the dispensing modules thereon and includes an internal air heater passage. Liquid and process air supply passages are provided in the manifold body. A plurality of liquid passages in the manifold body communicate with the liquid supply passage to provide the liquid material to the module(s). A plurality of process air passages in the manifold body communicate with the process air supply passage to provide process air to the module (s). A first heating member is positioned within the internal air heater passage and a gap is formed between the first heating member and the manifold body. The gap forms a portion of the process air supply passage. A second heating member is operatively coupled to the manifold body proximate the liquid passages and supplies heat to the liquid material in the liquid passages and also supplies heat the process air in the gap and the process air passages.

A first temperature sensor is positioned in the manifold body at a location such that the first temperature sensor senses a temperature approximating the temperature of the process air provided to the modules from the process air passages, while minimizing the thermal effects of the second heating member on the first temperature sensor. A second temperature sensor is positioned in the manifold body at a location such that the second temperature sensor senses a temperature approximating the temperature of the liquid material provided to the modules from the liquid passages, while minimizing the thermal effects of the first heating member on the second temperature sensor. Advantageously, the first and second heating members are comprised of identical heating elements. First and second embodiments are disclosed in which the first and second heating members respectively extend substantially parallel to and transverse to the longitudinal extent of the manifold body. The manifold body further includes first and second ends each having fastening elements for coupling the manifold body to another manifold body, in side-by-side relation, to expand the number of dispensing modules of the dispensing system. This feature is especially adapted for the embodiment having transversely extending heating members.

The first heating member or process air heating member preferably further comprises an elongate cylindrical member. The cylindrical member may be a cartridge style heating element of an appropriate diameter, but in the preferred embodiment, the elongate cylindrical member includes a lengthwise extending central passage and an elongate, electrically operated variable heating element is positioned within the central passage. A groove is located on an outer surface of the cylindrical member and extends at least substantially around the circumference of the elongate cylindrical member. The groove is configured to receive process air to be heated by the elongate cylindrical member and communicates with the gap. The process air is heated by the manifold block on one side of the gap and by the first heating member on the opposite side of the gap. Since the manifold block is directly heated by the second heating member, the load for heating the process air is shared between the first and second heating members. Also, since the first heating member, e.g., the elongate cylindrical member, is spaced from the manifold block by the aforementioned gap, the heat supplied to the process air is effectively carried away by the process air moving through the gap. This minimizes the effect of variations in the heat supplied to the process air by the first heating member on the liquid sections of the manifold body. Thus, the set point temperature of the liquid may be more precisely maintained as the process air temperature is varied by controlling the power to the first heating member.

The features and various advantages of the inventive aspects will become more readily apparent to those of ordinary skill in the art upon further review of the detailed description of the preferred embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
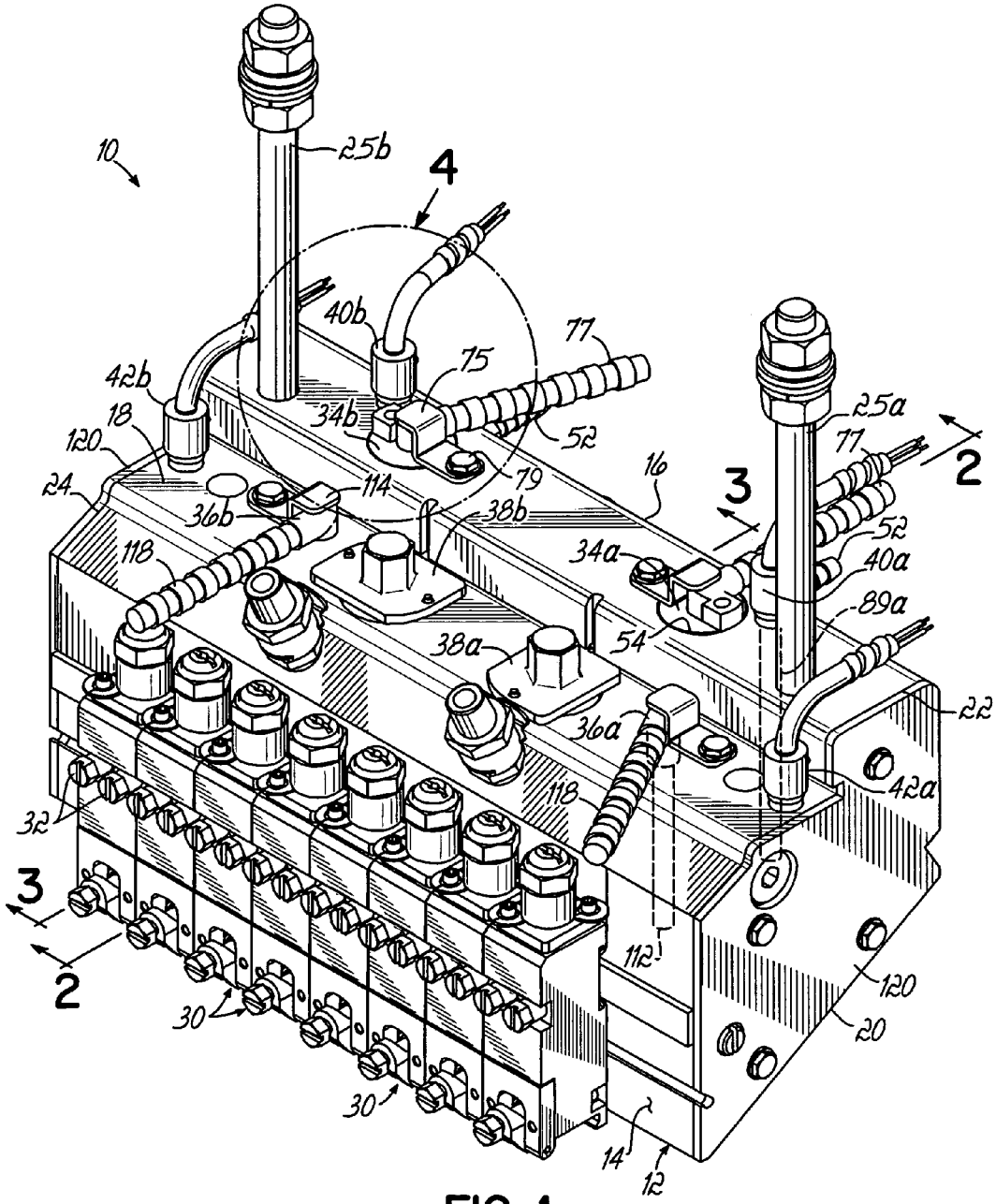
FIG. 1 is a perspective view of an exemplary liquid material dispenser of the present invention.

Referring to FIG. 1, there is shown an exemplary liquid material dispenser 10 according to the present invention. The liquid material dispenser 10 includes a unitary manifold body 12 which has been formed and machined to accommodate the various components of the liquid dispensing system, as will be described more fully below. The manifold body 12 has oppositely disposed front and rear surfaces 14, 16, oppositely disposed upper and lower surfaces 18, 20, and oppositely disposed longitudinal ends 22, 24. The manifold body 12 is supported by support members 25*a*, 25*b* attached to the upper surface 18 of the manifold body 12.

Several liquid dispensing modules 30 are secured to the front surface 14 of the manifold body 12 by fasteners 32. The dispensing modules 30 may be on/off-type modules with internal valve structure for selectively dispensing liquid material in the form of one or more filaments. An exemplary module of this type is disclosed in U.S. Pat. No. 6,089,413, commonly assigned to the assignee of the present invention and incorporated herein by reference in its entirety.

Liquid material, such as hot melt adhesive, and pressurized process air is supplied to the individual modules 30 through the manifold body 12 to thereby dispense beads or filaments of the liquid material to a substrate. The dispenser 10 further includes first, process air heating members 34*a*, 34*b* and second, liquid material heating members 36*a*, 36*b* for heating the air and liquid material, as will be described more fully below. Filters 38*a*, 38*b* are installed in the manifold body 12 to filter out contaminants from the liquid material supplied to the modules 30, and temperature sensors 40*a*, 40*b* and 42*a*, 42*b* are provided to measure the temperature of the liquid material and process air. Signals from the temperature sensors 40*a*, 40*b*, 42*a*, 42*b* are supplied to a controller (not shown) which controls the air and liquid heaters 34*a*, 34*b* and 36*a*, 36*b* to regulate the temperature of the air and adhesive dispensed from the modules 30. Each of the components described above is mounted to the unitary manifold body 12 as shown and described herein. In the description that follows, the dispenser of FIG. 1 includes two sets of process air passages through the manifold body, and two process air heaters. However, because the passages and heaters are identical, only one will be described, with the understanding that the description is applicable to the other air passages and other process air heater.

Figure 2:
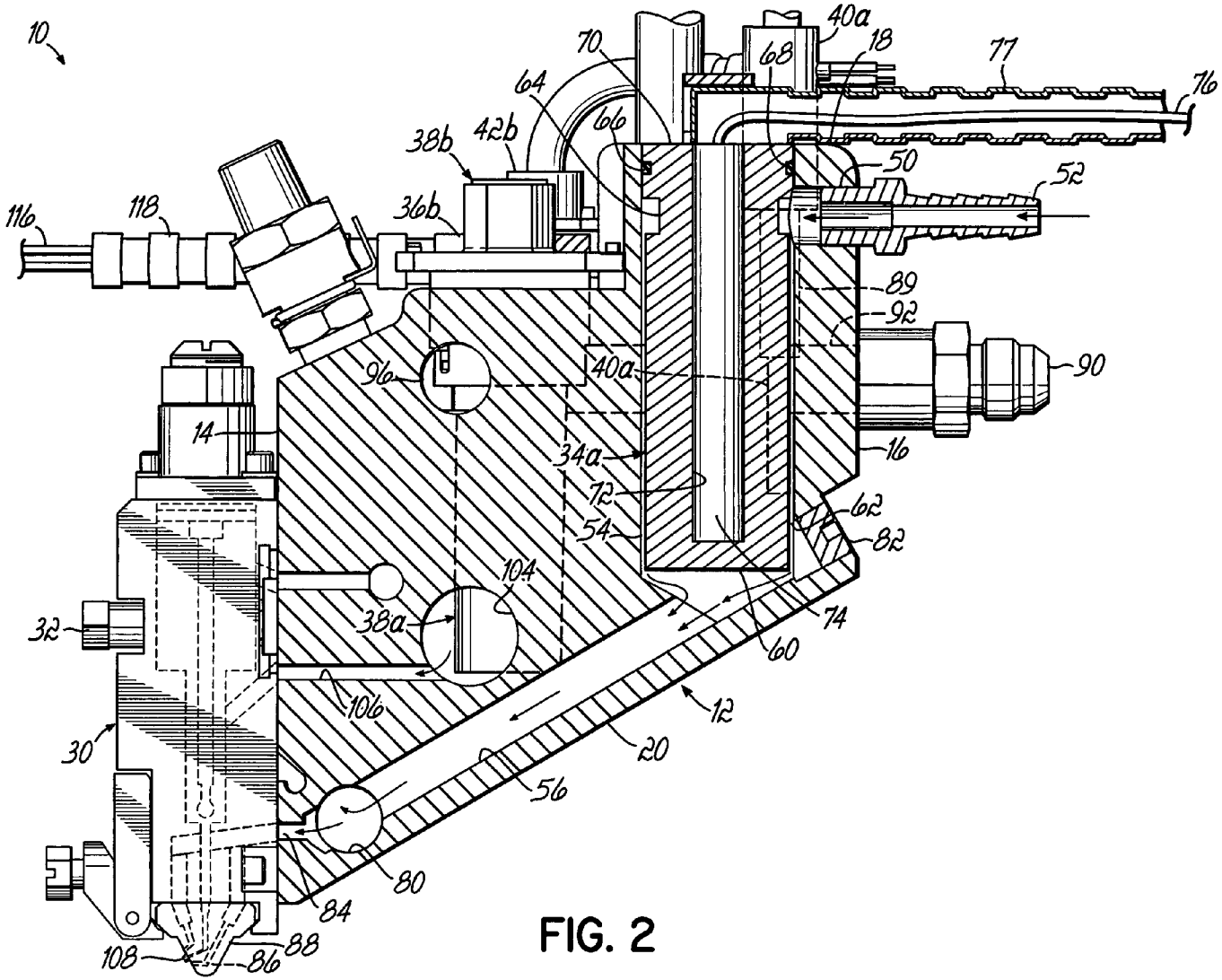
FIG. 2 is a cross-sectional view of the liquid material dispenser of FIG. 1, taken along lines 2—2.

Referring now to FIG. 2, there is shown a cross-sectional view of the liquid material dispenser 10 of FIG. 1, depicting the path of process air through the manifold body 12 to the dispensing modules 30. Process air is supplied to the dispenser 10 from a source of pressurized air (not shown) and is routed to the individual modules 30 through a series of interconnected passages. Process air enters the dispenser 10 through an air inlet port 50 formed in the rear surface 16 of the manifold body 12. A fitting 52 coupled to the air inlet port 50 facilitates the attachment of an air line connected to the pressurized air source.

A first, vertical bore 54 is formed through the top surface 18 of the manifold body 12 and extends downwardly through the manifold body 12 to intersect an air supply passage 56. The first bore 54 also communicates with the air inlet port 50 and is sized to receive the first heating member 34*a* for heating the incoming process air. In the embodiment shown, the first heating member 34*a* includes an elongate cylindrical member 60 that is received within the first bore 54 and spaced from the sidewalls of the first bore 54 to provide a clearance gap 62 along the length of the cylindrical member 60. In one embodiment, the clearance gap 62 is approximately 0.015 inch to 0.025 inch and process air is provided through the manifold body at a rate of approximately 0.5 to 2 SCFM (standard cubic-feet-per-minute) per module. The cylindrical member 60 is shown more clearly in FIG. 2A, which depicts another first heating member 34*b* removed from first bore 54.

Figure 2A:
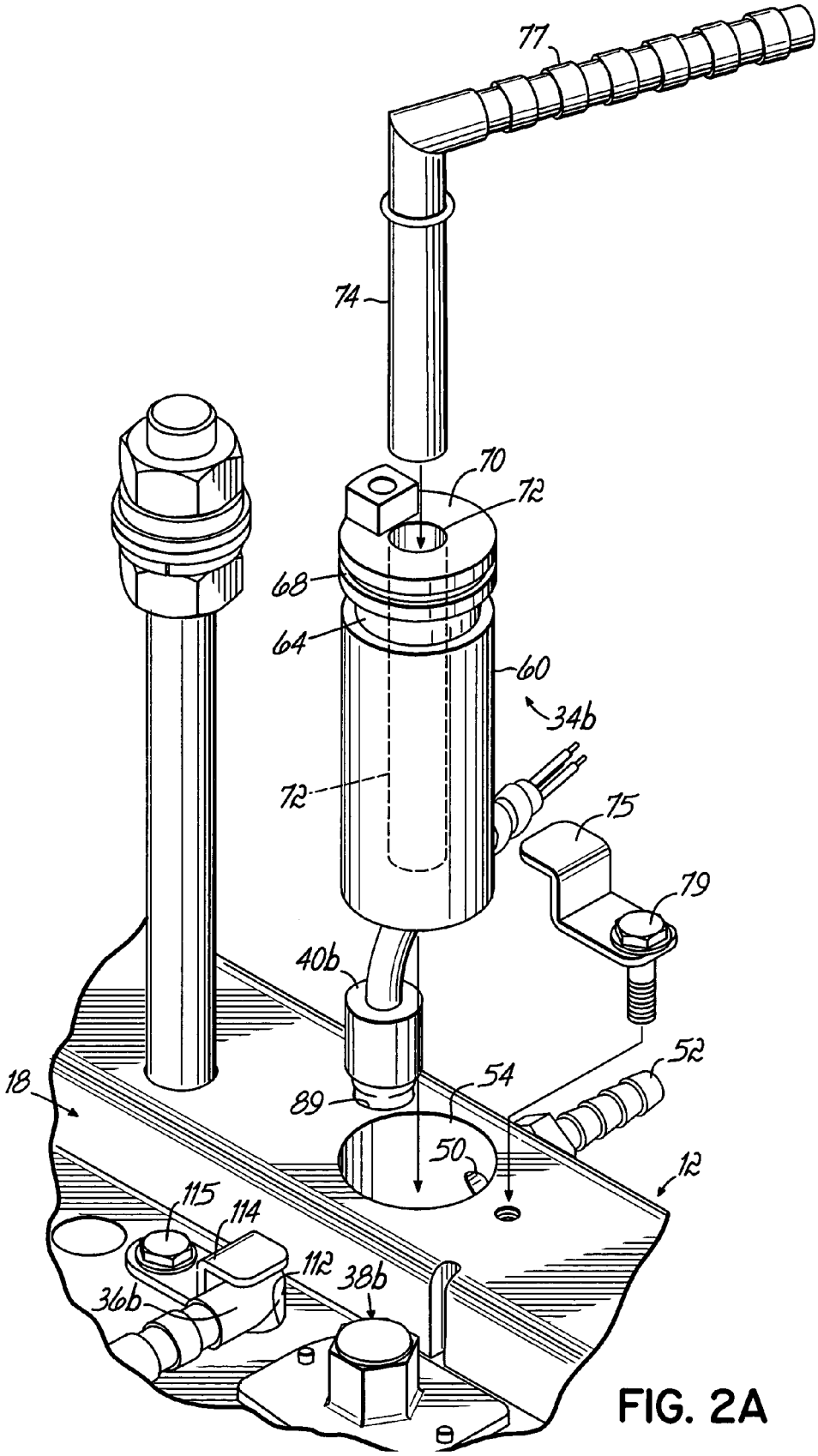
FIG. 2A is an exploded detail view of the encircled area of FIG. 1.

Referring to FIGS. 2 and 2A, a first circumferential groove 64 is formed in the cylindrical member 60, adjacent the air inlet port 50, whereby incoming process air may be evenly distributed around the cylindrical member 60 prior to being forced through the gap 62 toward the air supply passage 56. An O-ring 66 provided in a second circumferential groove 68 formed on a first end 70 of the cylindrical member 60, opposite the air supply passage 56, seals the first bore 54 and helps to center the cylindrical member 60 within the first bore 54. In an exemplary embodiment, the O-ring 66 is formed from a high-temperature resistant material such as Viton®.

The cylindrical member 60 is formed from a conductive material, such as metal, and has a central passage 72 extending along a longitudinal axis from the first end 70 toward the air supply passage 56. A first heating element 74 is disposed within the central passage 72 and is connected by an electrical lead 76, protected by conduit 77, to an appropriate power source (not shown). The heating element 74 and cylindrical member 60 are secured to the upper surface 18 of the manifold body by a clamp 75 and threaded fastener 79. In the embodiment shown, the heating element 74 is a cartridge heater, but it will be recognized that the heating element 74 may alternatively be other types of heating elements, as known in the art. Accordingly, when current is supplied to the heating element 74 through the electrical lead 76, the heating element 74 heats the cylindrical member 60 which, in turn, heats process air flowing through the inlet port 50 and along the gap 62 toward the air supply passage 56. The configuration of the first heating member 34*a* provides an efficient way to transfer heat to the process air. Specifically, the cylindrical member 60 is substantially enveloped in the process air such that heat from the cylindrical member must pass through the process air, except at the first end 70 where the cylindrical member 60 is sealed to the manifold body 12.

As shown in FIG. 2, the air supply passage 56 provides fluid communication between the first bore 54 and an air distribution passage 80 extending longitudinally through the unitary manifold body 12, along a direction parallel to the bank of liquid dispensing modules 30. In the exemplary embodiment shown, the air supply passage 56 is formed as a blind hole machined through the rear surface 16 of the manifold body 12. A plug 82 is provided at the rear surface 16 to seal the air supply passage 56 and is removable to facilitate cleaning and/or servicing of the air supply passage 56. Again, while only one process air heater 34*a* and one set of air passages 50, 54, 56 has been described and shown, the embodiment of FIG. 1 has two sets of air passages and two process air heaters, the other air passage and the second air heater 34*b* being identical to those described above.

With continued reference to FIG. 2, a plurality of air outlet passages 84 are formed in the front face 14 of the manifold body 12 and intersect the air distribution passage 80 whereby process air is provided from the air distribution passage 80 and through the outlet passages 84 to each module 30 secured to the front face 14 of the manifold body 12. Thereafter, process air travels through various air passages formed in the modules 30 and is dispensed from air discharge outlets 86 on dispensing dies 88 coupled to the respective modules 30, as known in the art.

As shown in FIGS. 1 and 2, a first temperature sensor 40*a* is installed in the manifold body 12, adjacent the first heating member 34*a*, through a bore 89 formed through the top surface 18 and extending parallel to the first bore 54. Advantageously, the location of the first temperature sensor 40*a* is selected such that the sensed temperature corresponds closely to the temperature of the process air discharged from the modules 30. The location of the first temperature sensor 40*a* may be determined, for example, by finite element analysis.

Figure 3:
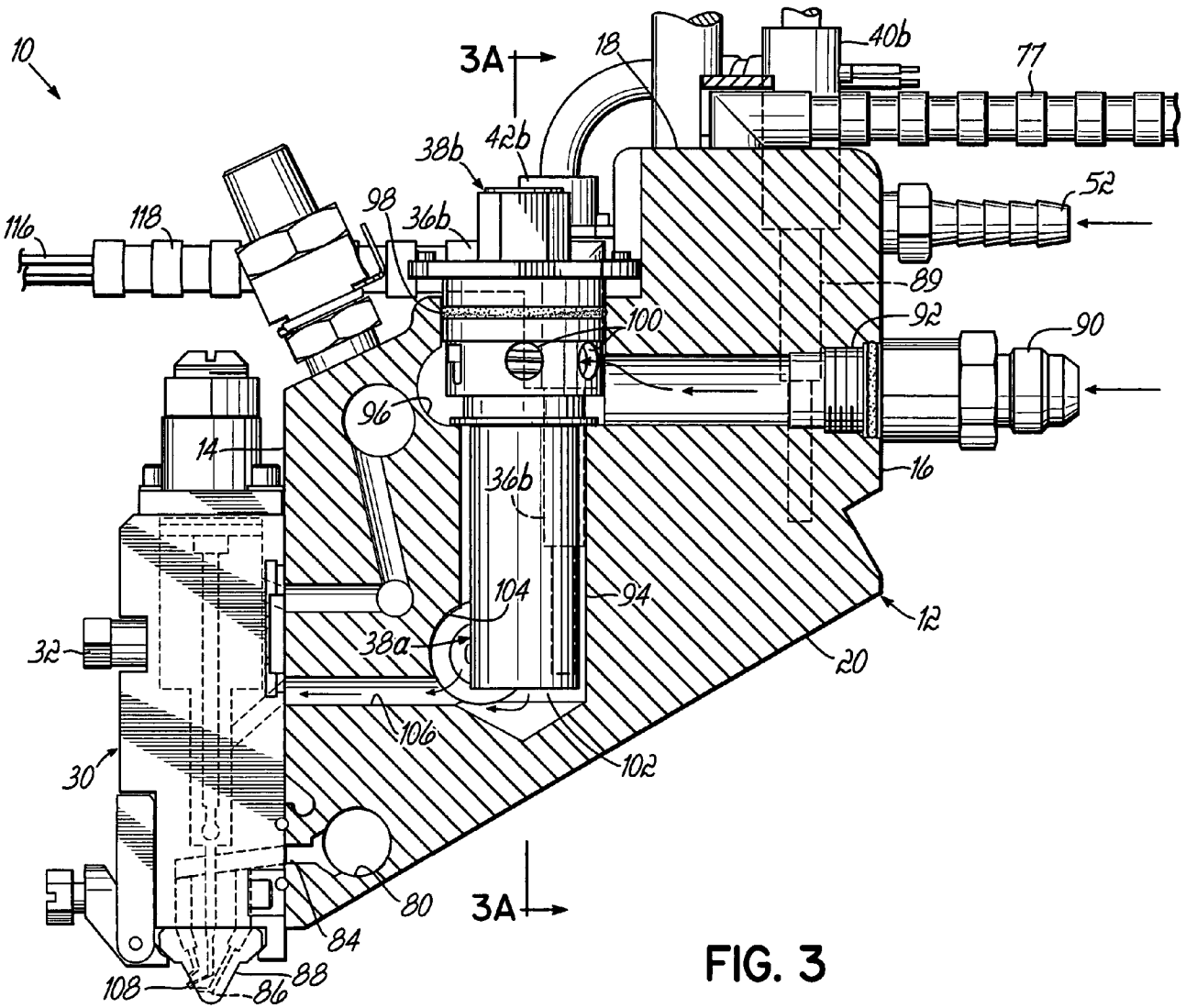
FIG. 3 is a cross-sectional view of the liquid material dispenser of FIG. 1, taken along lines 3—3.
Figure 3A:
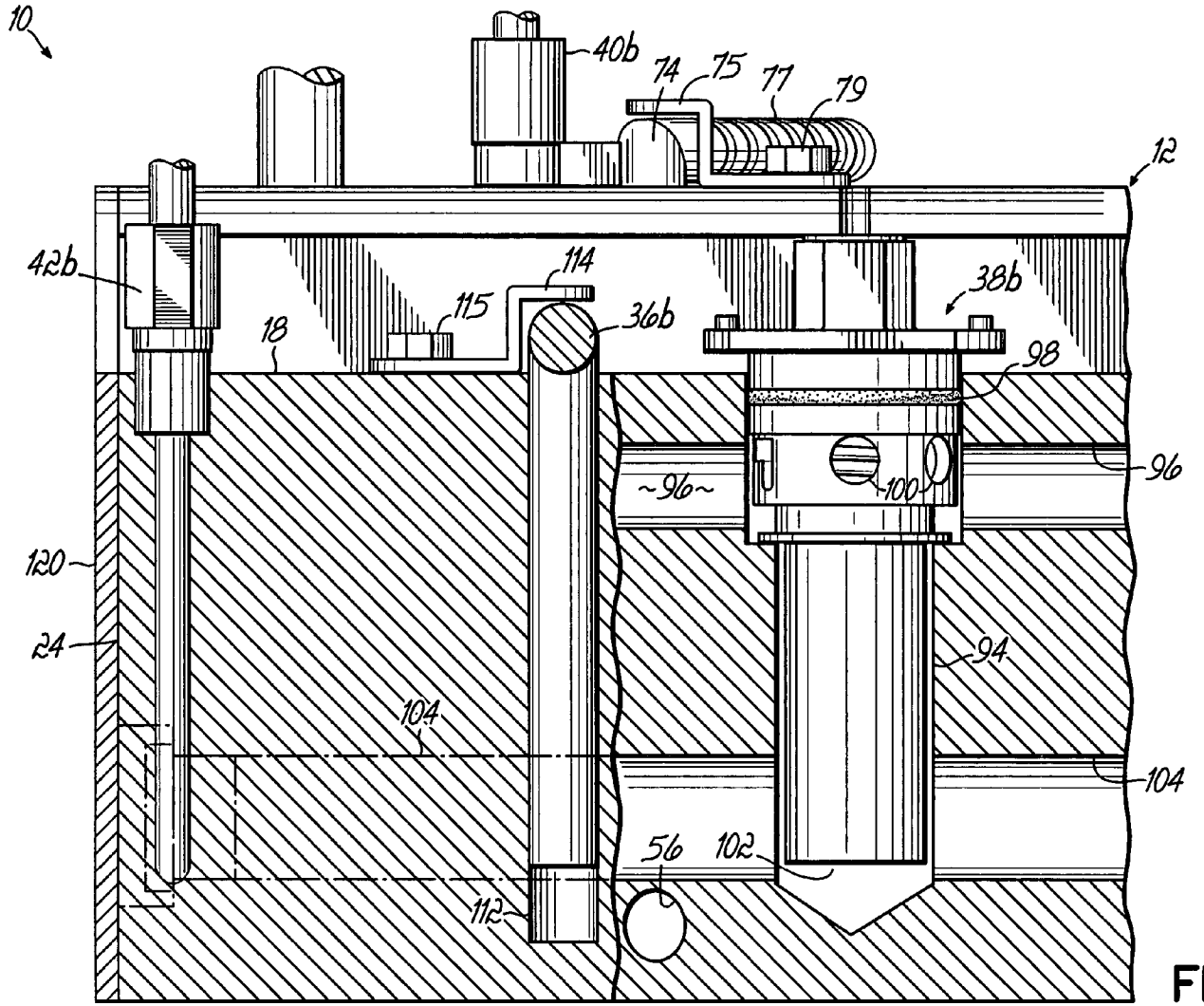
FIG. 3A is a cross-sectional view of the liquid material dispenser of FIG. 1, taken along lines 3A—3A of FIG. 3.

Referring now to FIGS. 3 and 3A, there are shown cross-sections through different portions of the unitary manifold body 12, depicting the path of liquid material through the manifold 12 to the dispensing modules 30. While the embodiment shown in FIG. 1 includes two liquid material filters and heaters, with associated liquid material passages, only one set of passages with the corresponding filter and heater will be described, it being understood that the description is equally applicable to the other liquid passages, filter and heater.

As shown in FIGS. 3 and 3A, liquid material is supplied to the manifold body 12 through a fitting 90 coupled to a liquid material inlet port 92 at the rear surface 16 of the manifold body 12. The inlet port 92 leads to a vertically-oriented filter cavity 94 formed into the manifold body 12 from the upper surface 18 and sized to receive a filter 38*b* for removing contaminants from the incoming liquid material. An inlet liquid supply passage 96 formed longitudinally through the manifold body 12 provides fluid communication between the two liquid material filters 38*a*, 38*b* so that the liquid material is distributed between the two filters and associated passages. The filter 38*b* is inserted into the filter cavity 94 from the upper surface 18 of the manifold body 12 and has an O-ring 98 to seal the upper end of the cavity 94. The filter 38*b* depicted in this embodiment is shown and described in co-pending U.S. patent application Ser. No. 10/831,016, entitled "A FILTER ASSEMBLY FOR A LIQUID DISPENSING APPARATUS" filed on Apr. 22, 2004 and assigned to the assignee of the present invention.

Liquid material enters the filter 38*b* through circumferentially spaced inlets 100 and circulates through the filter 38*b* whereafter filtered liquid material exits toward the bottom 102 of the filter cavity 94. Thereafter, the liquid material enters an adhesive distribution passage 104 communicating with the filter cavity 94 and extending longitudinally along the manifold body 12, adjacent the bank of liquid dispensing modules 30 and parallel to the process air distribution passage 80 and the inlet supply passage 96. As shown in FIG. 3, a plurality of liquid outlet passages 106 are formed into the manifold body 12, from the front surface 14, and intersect the liquid distribution passage 104 whereby liquid material flows from the liquid distribution passage 104, through the liquid outlet passages 106 to each of the dispensing modules 30 mounted on the front surface 14 of the manifold body 12. The liquid material travels through various liquid passages formed in the modules 30 and is discharged from one or more liquid discharge outlets 108 provided on dispensing dies 88 coupled to each module 30, as known in the art.

With continued reference to FIGS. 3 and 3A, the liquid material flowing through the liquid passages 92, 94, 104, 106 of the manifold body 12 is heated by a second heating member 36*b* disposed in a second, vertical bore 112 formed into the manifold body 12 from the upper surface 18 of the manifold body 12. In the embodiment shown, the second heating member 36*b* is located adjacent the filter cavity 94 whereby heat from heating member 36*b* is conducted through the manifold body 12 to heat liquid material flowing through the filter cavity 94 and other liquid passages 92, 104, 106. In this embodiment, the second heating member 36*b* is a cartridge heater which is secured within the vertical bore 112 by a clamp 114 fastened to the upper surface 18 of the manifold body 12 by a threaded fastener 115. Electrical leads 116 from the heater cartridge are routed through a protective conduit 118 connected to an appropriate current source, as known in the art.

As depicted in FIGS. 1 and 3A, a second temperature sensor 42*b* is mounted to the manifold body 12 at a position where the sensed temperature closely corresponds to the temperature of the liquid material discharged from the dispensing modules 30. In another embodiment, the locations of the first and second temperature sensors 40*a*, 42*a* are selected to minimize the effects of the heater associated with the other temperature sensor, to approximate a thermally decoupled system. This permits the controller to more accurately control each heater to heat the liquid material and the process air to desired operating ranges.

Because both the first and second heating members 34*a*, 34*b* and 36*a*, 36*b* are mounted directly within the manifold body 12, and because the liquid and adhesive passages are formed through the unitary manifold body 12, it will be recognized that heat emanating from the second heating members 36*a*, 36*b* is conducted through the manifold body 12 to heat not only the liquid material, but also the process air flowing through the process air passages. Specifically, heat conducted through the manifold body 12 from the second heating members 36*a*, 36*b* provides heat to portions of the manifold body 12 surrounding the first bore 54 to cooperate with the first heating members 34*a*, 34*b* to heat process air flowing through the clearance gap 62 and other air passages 50, 54, 56. However, heat from the first heating members 34*a*, 34*b* is substantially isolated from the rest of the manifold body 12 by the process air flowing through the clearance gap 62 and therefore does not significantly affect the temperature of the liquid material flowing through the manifold body 12. This arrangement, in conjunction with the configuration of the first heating members 34*a*, 34*b* discussed above, provides a robust and efficient mechanism for heating the process air and minimizes heat loss between the first heating members 34*a*, 34*b* and the process air. Because heat loss from the first heating members 34*a*, 34*b* is minimized, the heating elements 74 of the first heating members 34*a*, 34*b* do not have to be overdesigned to obtain a desired temperature rise in the process air.

Referring again to FIG. 1, the adhesive dispenser 10 of the present invention includes insulating endplates 120 mounted on the respective longitudinal ends 22, 24 of the manifold body 12. Advantageously, the end plates 120 help to minimize heat loss through the ends 22, 24 of the manifold body, thereby improving the thermal efficiency of the dispenser 10.

While the liquid dispenser 10 has been shown and described herein as having two sets of first and second heating members, filters, and associated air and liquid passages, it will be recognized that a liquid dispenser could alternatively be provided with only a single set of heaters, filters and associated air and liquid passages, or alternatively more than two sets of heaters, filters, and passages, as may be required for a particular application. Moreover, the vertical arrangement of heaters and filters facilitates adding additional manifold segments to accommodate a greater number of liquid dispensing modules 30, or alternatively providing additional heaters, filters, and associated flow passages into a common manifold.

Figure 4:
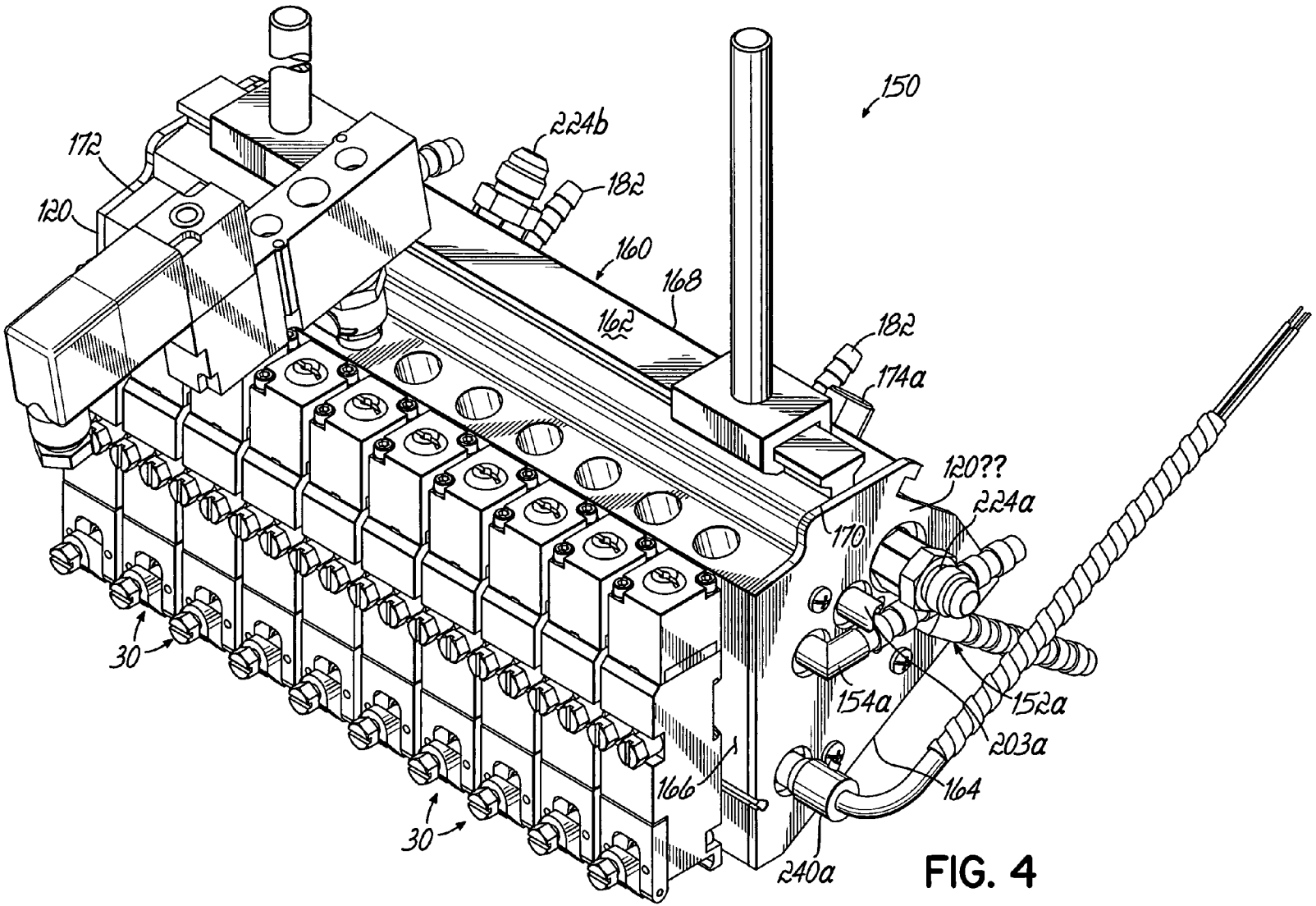
FIG. 4 is a perspective view of another exemplary liquid material dispenser according to the present invention.
Figure 5:
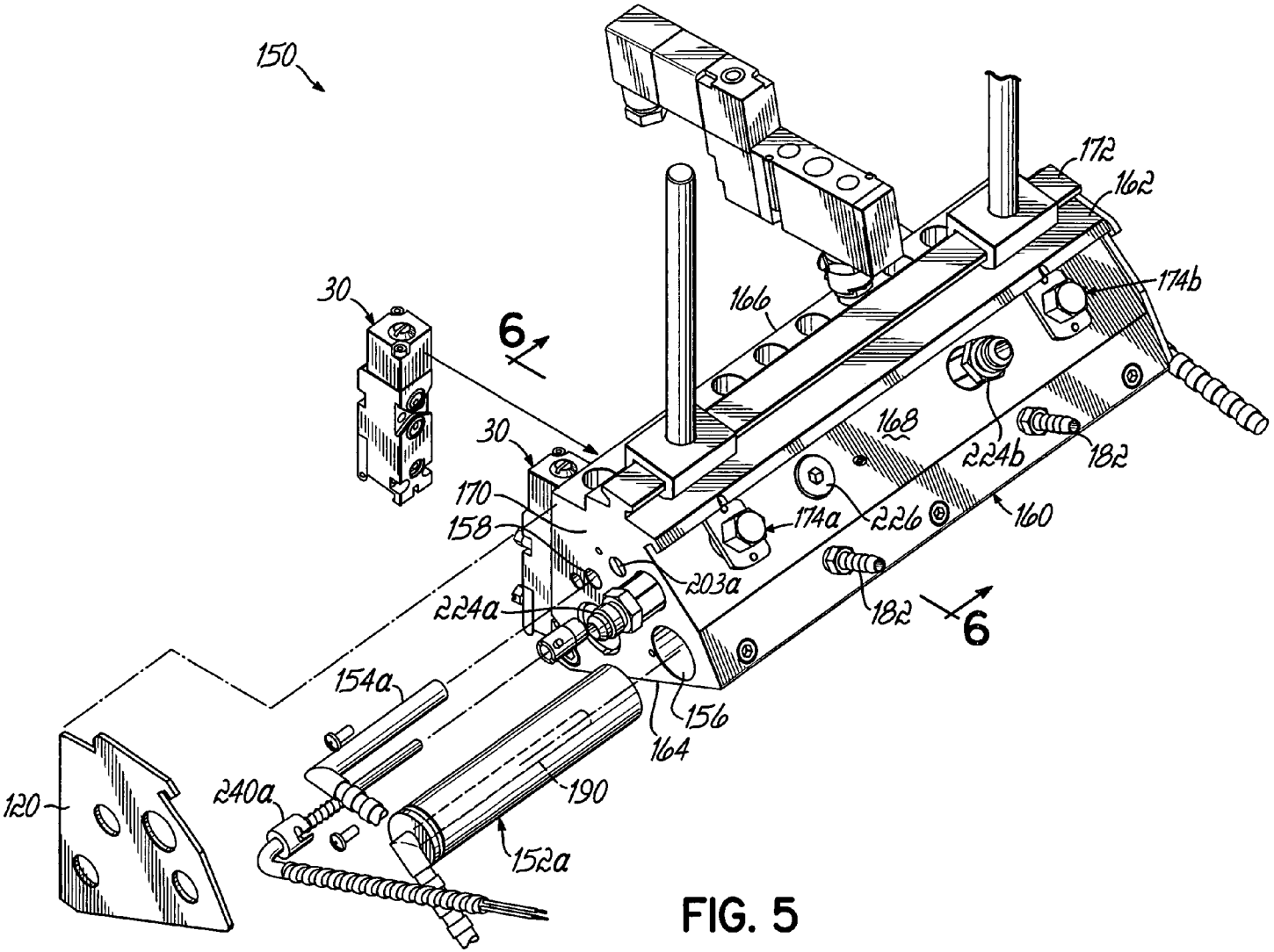
FIG. 5 is an exploded perspective view of the liquid material dispenser of FIG. 4, viewed from the rear.

Referring now to FIGS. 4 and 5, there is shown another embodiment of an adhesive dispenser 150 according to the present invention. The adhesive dispenser 150 shown in this embodiment is similar to the dispenser 10 depicted in FIGS. 1–3, with the exception that instead of vertically-oriented heating members, the first and second heating members 152, 154 are disposed in respective first and second bores 156, 158 of a unitary manifold body 160 having longitudinal axes extending in directions substantially parallel to the longitudinal direction of the manifold body 160. The manifold body 160 has upper and lower surfaces 162, 164, front and rear surfaces 166, 168, and oppositely disposed longitudinal lends 170, 172. A bank of liquid dispensing modules 30 are operatively coupled to the front surface 166 of the manifold body 160, in a manner similar to that previously described with respect to the dispenser 10 of FIGS. 1–3. In this embodiment, the various fittings for coupling the manifold body 160 to liquid material and process air supply lines, as well as access openings or bores for the heating members 152, 154 and liquid filters 174*a*, 174*b* are provided on the rear surface 168 and longitudinal ends 170, 172 instead of the top surface 162 of the manifold body 160, as will be described more fully below.

Figure 6:
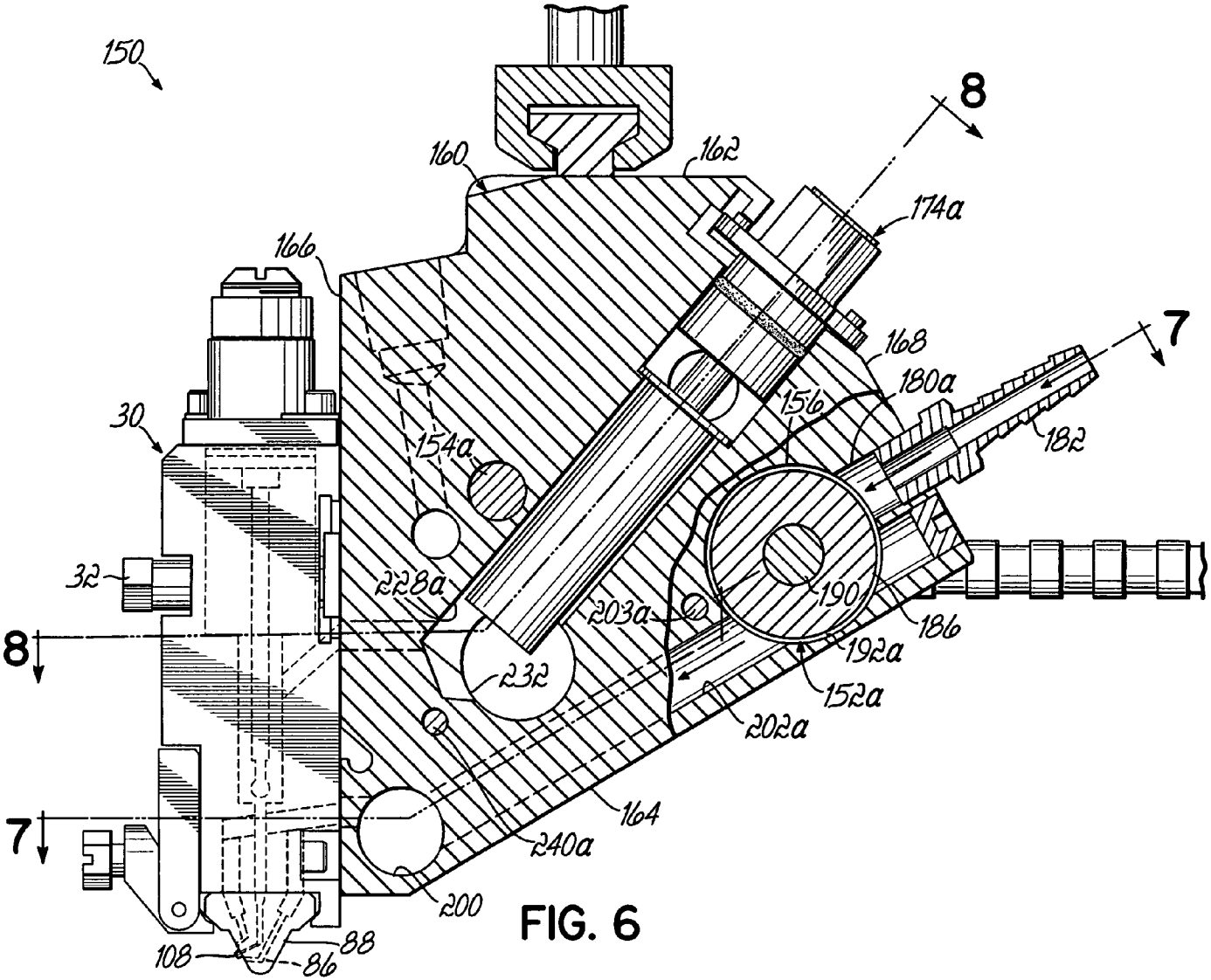
FIG. 6 is a cross-sectional view of the liquid dispenser of FIG. 4, taken along lines 6—6.
Figure 7:
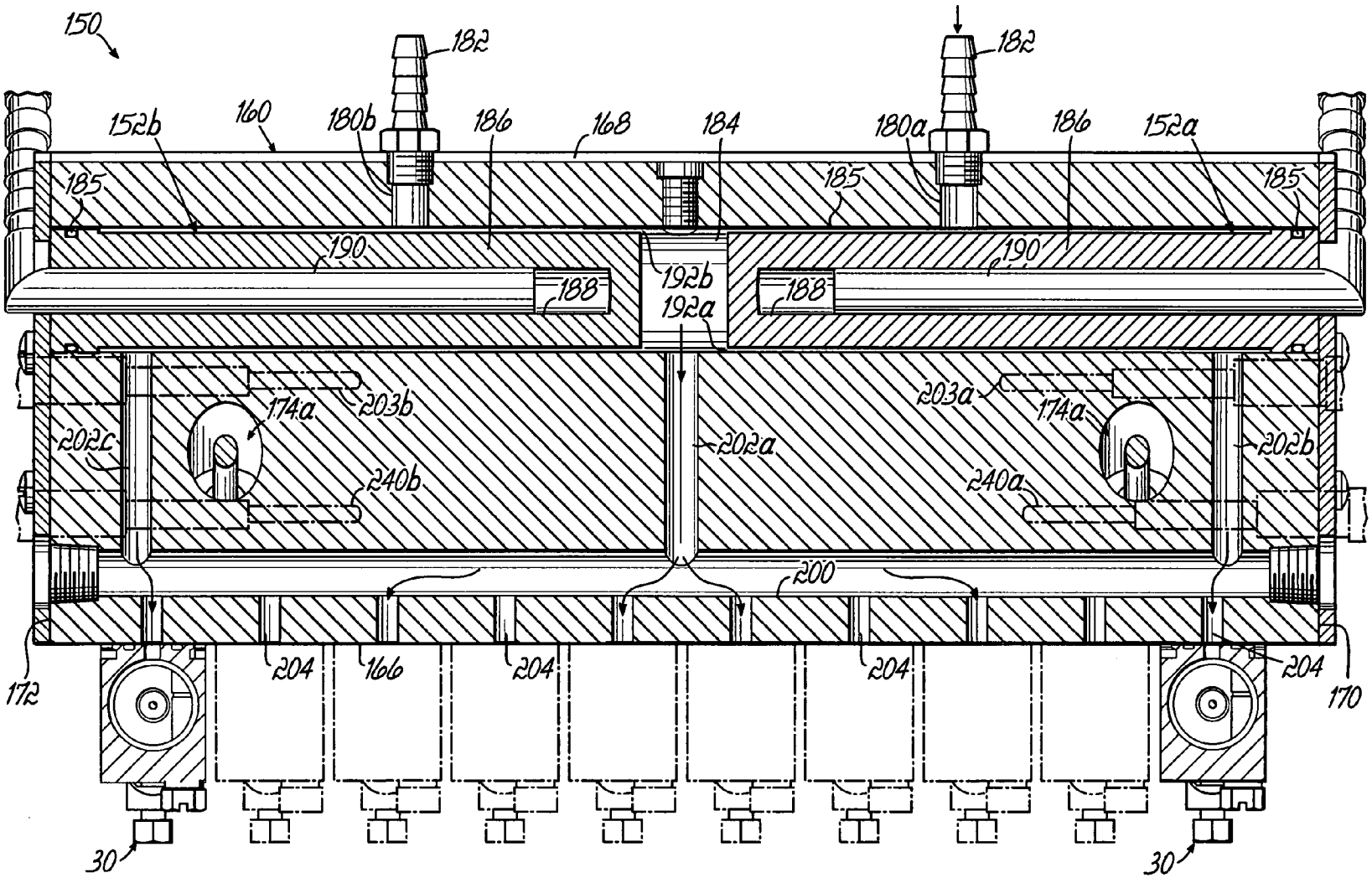
FIG. 7 is a cross-sectional view of the liquid dispenser of FIG. 4, taken along lines 7—7 of FIG. 6.

Referring now to FIGS. 6 and 7, the flow path of the process air through the manifold body 160 of this embodiment will now be described. The manifold body 160 has provisions for two process air inlet ports 180*a*, 180*b*, both located on the rear surface 168 of the manifold body 160. Appropriate fittings 182 are installed at the first and second air inlet ports 180*a*, 180*b* to couple the air inlet ports 180*a*, 180*b* to a source of pressurized air (not shown). The air inlet ports 180*a*, 180*b* are in fluid communication with a first bore 184 formed through the manifold body 160 along a direction parallel to the longitudinal axis of the manifold body 160. A pair of first air heating members 152*a*, 152*b* are disposed in the first bore 184, from opposite longitudinal ends 170, 172 of the manifold body 160. First bore 184 is sealed at its longitudinal ends by O-rings 185 provided on the first heating members 152*a*, 152*b* in a manner similar to that described above for the embodiment of FIGS. 1–3.

The first heating members 152*a*, 152*b* comprise elongate cylindrical members 186 having central passages 188 for receiving heating elements 190, as described above. In the embodiment shown, the heating elements 190 are cartridge heaters with electrical wiring for coupling the cartridge heaters to appropriate power sources. The cylindrical members are spaced from the bore 184 to provide annular gaps 192*a*, 192*b* which extend along the lengths of the cylindrical members 186. The air inlet ports 180*a*, 180*b* are in fluid communication with the first bore 184 whereby air from the source is directed through the inlet ports 180*a*, 180*b* to the first bore 184 and along the gaps 192*a*, 192*b* between the cylindrical members 186 and the first bore 184. As the air travels through the gaps 192*a*, 192*b*, it is heated by the heating members 152*a*, 152*b*, as discussed above with respect to FIGS. 1–3.

With continued reference to FIGS. 6 and 7, an air distribution passage 200 extends longitudinally along the manifold body 160, adjacent the bank of dispensing modules 30, similar to the air distribution passage 80 of FIGS. 1–3. The air distribution passage 200 is in fluid communication with the first bore 184 through three air supply passages 202*a*, 202*b*, 202*c* extending therebetween. Several air outlet passages 204 are formed through the front surface 166 of the manifold body 160 and are in fluid communication with the air distribution passage 200 whereby air entering the manifold 160 through the inlet ports 180*a*, 180*b* is directed through the first bore 184, through the air supply passages 202*a*, 202*b*, 202*c*, through the air distribution passage 200 and air outlet passages 204, to respective dispensing modules 30, as previously described.

First temperature sensors 203*a*, 203*b* are coupled to the manifold body 160 through longitudinal cavities formed through the longitudinal ends 170, 172 thereof, adjacent the first bore 156, and extending toward the center of the manifold body 160. In this embodiment, the temperature sensors are located at positions to sense temperatures that closely correspond to the temperature of the process air moving through the air passages and discharged from the dispensing modules 30.

Figure 8:
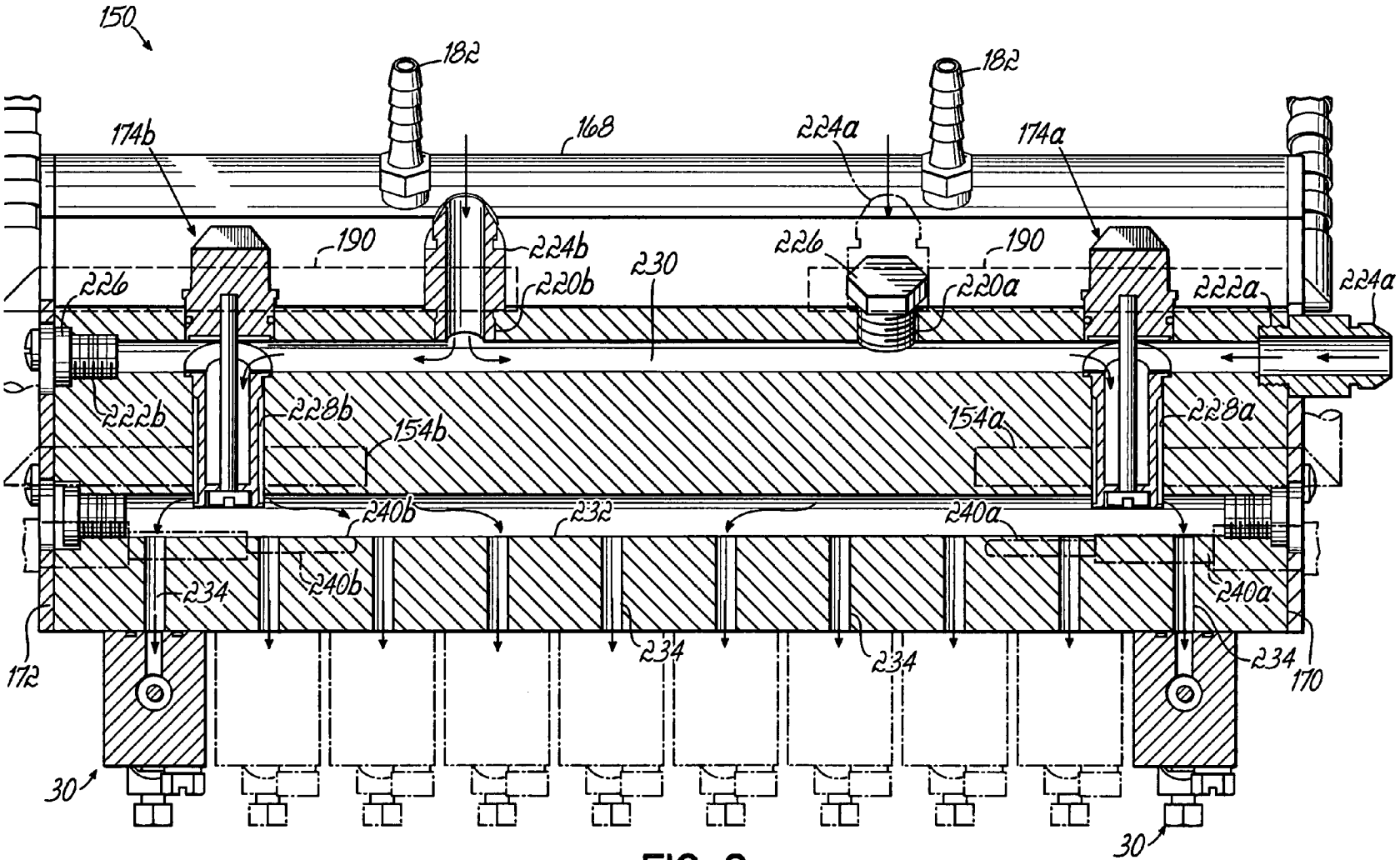
FIG. 8 is a cross-sectional view of the liquid dispenser of FIG. 4, taken along lines 8—8 of FIG. 6.
Figure 9:
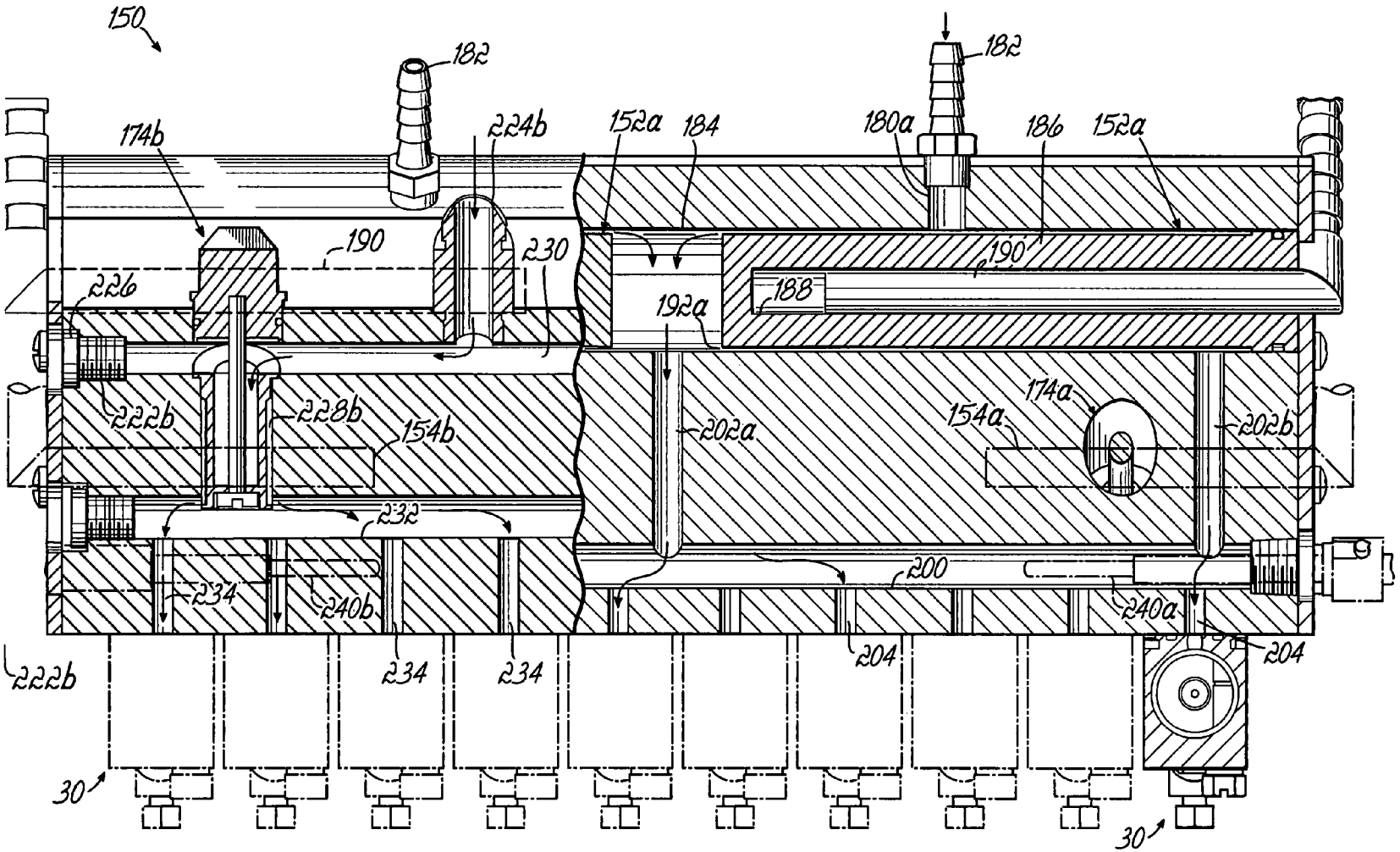
FIG. 9 is a fragmented combination of the cross sections shown in FIGS. 7 and 8 to show both the liquid and air portions of the manifold.

Referring now to FIGS. 6 and 8, the flow of the liquid material through the dispenser 150 will now be described. Because the air and liquid passages are formed through different portions of the unitary manifold body 160, the locational relationship between the air and liquid passages in the manifold body 160 can be appreciated by reference to these figures and with further reference to FIG. 9, which depicts a fragmented cross section showing both of these passages.

As shown most clearly in FIG. 8, the manifold body 160 of the dispenser 150 includes four ports for supplying liquid material to the manifold body 160, two ports 220*a*, 220*b* provided on the rear surface 168 of the manifold body 160 and additional ports 222*a*, 222*b* provided on each of the longitudinal ends 170, 172. In the embodiment shown, a liquid inlet fitting 224*b* is coupled to a port 222*b* on the second end 172 of the manifold body 160 and a second inlet fitting 224*a* is coupled to an inlet port 220*a* on the rear surface 168 of the manifold body 160. The remaining inlet ports 220*b*, 222*a* are sealed with threaded plugs 226, but it will be recognized that fittings may alternatively be secured to these other ports, as may be required for a particular application.

The multiple liquid inlet ports 220*a*, 220*b* and 222*a*, 222*b* (collectively referred to herein as 220, 222) on the manifold body 160 facilitate convenient routing of liquid supply hoses (not shown) to the dispenser 150. The liquid inlet ports 220, 222 are in fluid communication with first and second filter cavities 228*a*, 228*b* by a liquid material inlet supply passage 230 extending longitudinally through the manifold body 160, whereby liquid material supplied to the manifold body 160 from appropriate liquid sources (not shown) is routed through the filters 174*a*, 174*b* and exit toward the bottoms of the filter cavities 228*a*, 228*b*, as previously described with respect to FIGS. 1–3.

A liquid distribution passage 232 extends longitudinally along the manifold body 160, similar to the liquid distribution passage 104 of FIGS. 1–3, and is in fluid communication with the bottoms of the filter cavities 228*a*, 228*b*. Liquid outlet passages 234 are formed through the front surface 166 of the manifold body 160 and are in fluid communication with the liquid distribution passage 232 whereby liquid material supplied through the inlet ports 220, 222 goes through the liquid filters 174*a*, 174*b* and filter cavities 228*a*, 228*b*, through the liquid distribution passage 232, and through the liquid outlet passages 234 to the individual modules 30 for dispensing from the modules 30, as previously described.

As depicted in FIGS. 6 and 8, second heating members 154*a*, 154*b* are coupled to the manifold body 160 through the respective first and second longitudinal ends 170, 172 and extend longitudinally along the manifold body 160 toward the center of the dispenser 150. In the embodiment shown, the second heating members 154*a*, 154*b* are cartridge heaters that generate heat when coupled to an appropriate power source, as discussed above. The heat is conducted through the manifold body 160 to the liquid passages 228, 230, 232, 234 to thereby heat the liquid material flowing through the liquid passages. Second temperature sensors 240*a*, 240*b* are also coupled to the manifold body 160 and extend longitudinally along the manifold body 160 from respective longitudinal ends 170, 172, adjacent the liquid distribution passage 232, to measure the temperature of the manifold body 160 at those locations.

Advantageously, the locations of the second temperature sensors 240*a*, 240*b* are selected so that the sensed temperatures are very close to that of the liquid material flowing through the liquid distribution passage 232 and provided to the modules 30. In another embodiment, the locations of the first and second temperature sensors 203*a*, 203*b* and 240*a*, 240*b* are selected to minimize the effects of the heater associated with the other temperature sensor, to approximate a thermally decoupled system. This permits the controller to more accurately control the heating members to heat the liquid material and the process air to desired temperature ranges. Moreover, the second heating members 154*a*, 154*b* cooperate with the first heating members 152*a*, 152*b* to heat the process air flowing through clearance gaps 192*a*, 192*b* and other air passages 184, 200, 202*a*–202*c*, but the first heating members 152*a*, 152*b* do not affect the temperature of the liquid material, as discussed above.

The manifold bodies of the embodiments described herein lend themselves to fabrication by extrusion methods. Specifically, the uniform profile of the upper and lower surfaces and the front and rear surfaces of the manifold bodies facilitate forming the manifold bodies by extrusion in the longitudinal direction. After extrusion, various other features, such as screw threads and the various bores and cavities which do not extend in the longitudinal direction, may be machined into the manifold body. Furthermore, it will be appreciated that cavities and bores which extend in the longitudinal direction may be formed in the manifold body during extrusion. For example, the liquid inlet supply passage 96 and the liquid distribution passage 104 of the embodiment of FIGS. 1–3A can be extruded into the manifold body 12. In the embodiment of FIGS. 4–10, the first bore 184, the air distribution passage 200, the liquid material inlet supply passage 230 and the liquid distribution passage 232 can be extruded into the manifold body 160. Even when tight tolerances between components are required, these bores and passages can be extruded to nominal dimensions and subsequently machined to the desired dimensions, thereby reducing the overall manufacturing time.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. An integrated manifold for a dispensing system adapted to dispense liquid material and process air from at least one dispensing module coupled thereto, the manifold comprising:

an integrally formed manifold body configured to receive the dispensing modules thereon, said manifold body having an internal air heater passage;

a liquid supply passage in said manifold body;

a process air supply passage in said manifold body;

a plurality of liquid passages in said manifold body in communication with said liquid supply passage for providing the liquid material to the modules;

a plurality of process air passages in said manifold body in communication with said process air supply passage for providing process air to the modules;

a first heating member positioned within said internal air heater passage a gap formed between said first heating member and said manifold body, said gap forming a portion of said process air supply passage; and a second heating member operatively coupled to said manifold body proximate said liquid passages and operative to supply heat to the liquid material in said liquid passages and the process air in said gap and said process air passages.

2. The integrated manifold of claim 1, further comprising:

a first temperature sensor in said manifold body at a location such that said first temperature sensor senses a temperature approximating the temperature of the process air provided to the modules from said process air passages, while minimizing the thermal effects of said second heating member on said first temperature sensor; and a second temperature sensor in said manifold body at a location such that said second temperature sensor senses a temperature approximating the temperature of the liquid material provided to the modules from said liquid passages, while minimizing the thermal effects of said first heating member on said second temperature sensor.

3. The integrated manifold of claim 1, wherein said first and second heating members include identical heating elements.

4. The integrated manifold of claim 1, wherein said manifold body includes a longitudinal extent along which a plurality of dispensing modules are adapted to be coupled and said first and second heating members extend substantially parallel to said longitudinal extent.

5. The integrated manifold of claim 1, wherein said manifold body includes a longitudinal extent along which a plurality of dispensing modules are adapted to be coupled and said first and second heating members extend transverse to said longitudinal extent.

6. The integrated manifold of claim 5, wherein said manifold body further includes first and second ends each having fastening elements for coupling said manifold body to another manifold body, in side-by-side relation, to expand the number of dispensing modules of the dispensing system.

7. The integrated manifold of claim 1, wherein said first heating member further comprises an elongate cylindrical member.

8. The integrated manifold of claim 7, wherein said elongate cylindrical member includes a central passage extending lengthwise along said elongate cylindrical member, and further comprising an elongate heating element positioned within said central passage.

9. A liquid dispenser for dispensing liquid material and process air, comprising:

an integrally formed manifold body;

a plurality of liquid dispensing modules coupled to said manifold body;

a process air inlet port formed in said manifold body for receiving the process air;

a first bore formed in said manifold body in fluid communication with said process air inlet port;

a plurality of process air outlet passages formed in said manifold body in fluid communication with said first bore for providing the process air to said dispensing modules;

a liquid inlet port formed in said manifold body for receiving the liquid material;

a plurality of liquid outlet passages formed in said manifold body in fluid communication with said liquid inlet port for providing the liquid material to said dispensing modules;

a second bore formed in said manifold body;

a first heating member positioned in said first bore, a gap in said first bore between said first heating member and said manifold body, said gap in fluid communication with said process air inlet port and said process air outlet passages; and a second heating member positioned in said second bore.

10. The liquid material dispenser of claim 9, wherein said first heating member comprises:

an elongate cylindrical member extending lengthwise within said first bore, said gap extending circumferentially around said elongate cylindrical member and along a substantial portion of the length of said elongate cylindrical member.

11. The liquid material dispenser of claim 10, wherein said elongate cylindrical member further includes a central passage extending lengthwise therein, and further comprising:

an elongate heating element positioned within said central passage of said cylindrical member.

12. The liquid material dispenser of claim 9, wherein said manifold body is an extrusion.

* * * * *